United States Patent [19]

Penson

[11] Patent Number: 4,830,354

[45] Date of Patent: May 16, 1989

[54] SHEET FEED APPARATUS AND CARTRIDGE THEREFOR

[75] Inventor: Christopher J. Penson, Hertfordshire, England

[73] Assignee: Xerox Corporation, Stamford, Conn.

[21] Appl. No.: 48,160

[22] Filed: May 11, 1987

[30] Foreign Application Priority Data

May 14, 1986 [GB] United Kingdom ..... 8611792

[51] Int. Cl.[4] ..... B65H 1/08

[52] U.S. Cl. ..... 271/147; 271/157; 271/162; 271/126; 221/198

[58] Field of Search ..... 221/45, 56, 198, 226, 221/231, 287, 46, 197, 244; 271/147, 157, 162, 22, 24, 30.1, 126, 128; 206/449, 555, 556; 414/118, 117

[56] References Cited

U.S. PATENT DOCUMENTS

| | | | |
|---|---|---|---|
| 2,391,125 | 12/1945 | Carpenter | 206/449 X |
| 3,635,468 | 1/1972 | Suzuki | 221/198 X |
| 3,758,105 | 9/1973 | Okamoto | 221/198 X |
| 3,767,188 | 10/1973 | Rosenberg, Jr. et al. | 221/287 X |
| 3,919,972 | 11/1975 | Komori et al. | 271/118 |
| 4,248,525 | 2/1981 | Sterrett | 355/14 SH |
| 4,390,175 | 6/1983 | Takahashi | 271/157 |
| 4,466,604 | 8/1984 | Kishimoto et al. | 271/111 |
| 4,504,053 | 3/1985 | Shiozawa | 271/34 |
| 4,555,105 | 11/1985 | Wyatt | 271/264 |
| 4,569,587 | 2/1986 | Miyoshi | 355/72 |
| 4,605,214 | 8/1986 | Hanning et al. | 221/198 X |

FOREIGN PATENT DOCUMENTS

| | | | |
|---|---|---|---|
| 2952671 | 7/1980 | Fed. Rep. of Germany . | |
| 2019154 | 6/1970 | France . | |
| 112540 | 6/1985 | Japan | 271/157 |
| 1126376 | 9/1968 | United Kingdom . | |
| 2012246 | 3/1982 | United Kingdom . | |
| 2019366 | 10/1982 | United Kingdom . | |
| 2041886 | 1/1983 | United Kingdom . | |
| 2076786 | 9/1983 | United Kingdom . | |
| 2120214 | 11/1983 | United Kingdom . | |
| 2129405 | 5/1984 | United Kingdom . | |
| 2141406 | 12/1984 | United Kingdom . | |

*Primary Examiner*—Joseph J. Rolla
*Assistant Examiner*—David H. Bollinger
*Attorney, Agent, or Firm*—Mark Costello

[57] ABSTRACT

A top-sheet feeding apparatus having an automatically elevating stack support tray (100) to keep the top sheet of the stack (5) in operative contact with sheet feed mechanism (10). An upwardly projecting member (2) is present on the tray. The stack of sheets is provided in a cartridge (3) which simplifies the change over of throughput material and reduces the risk of damage and contamination both during handling and storage. The cartridge (3) comprises a generally enclosed rectangular container (4) holding the stack of sheets (5). The container has three openings as follows: (i) in its top face (6*b*) a cut out portion (9) exposing a portion of the top sheet to permit engagement by the sheet feed mechanism (10), (ii) in a side face (6*c*) a slot (11) through which sheets can be fed out from the top of the stack, and (iii) in bottom face (6*a*) an aperture (7) slightly larger than the projecting member (2). The cartridge (3) also comprises a vertically movable plate (8) for supporting the stack (5). The plate (8) is disposed within the container (4) adjacent the bottom face (6*a*) and extends over the aperture (7) therein such that the block (2) of the elevating tray (100) bears against the underside of plate (8) to raise the plate and the stack, thus maintaining the top sheet of the stack in operative contact with the sheet feed mechanism (10).

6 Claims, 2 Drawing Sheets

5
10
100

4
5
6b
9
A
10
B
11
6c
100

10
5
3
4
6a
7
2
8
1
100

SHEET FEED APPARATUS AND CARTRIDGE THEREFOR

This invention relates to a sheet feed apparatus, particularly but not exclusively for use in a xerographic or like copier, comprising a support tray for a stack of sheets to be fed, and means for feeding the top sheet of the stack, wherein the tray is elevated automatically to maintain the top sheet of the stack in operative contact with the sheet feed means. The invention also relates to a cartridge for holding a stack of sheets for use in such apparatus, and further relates to an adaptor for converting a sheet feed apparatus having an automatically elevating stack support tray to operate with a stack of sheets provided in such a cartridge.

CROSS-REFERENCE TO RELATED APPLICATIONS

Cross-reference is hereby made to related U.S. patent application Nos. 654,706 filed Sept. 27, 1984, and 654,705 filed Sept. 27, 1984, both assigned to the same assignee as the present application.

BACKGROUND OF THE INVENTION

Sheet feeders with automatically elevating support trays are well known and are used particularly in high performance commercial copies where high capacity trays are required. For example, in the Xerox 9700 and 1050 machines, the main copy sheet supply tray in both cases is of this automatic elevator type. The operator places a loose stack of sheets on the tray by hand. Then when an appropriate signal is given, e.g. by pressing a control button or closing a cover door, the tray is raised automatically until the top sheet of the stack is brought into operative contact with the feed mechanism. As the sheets are fed from the top of the stack into the processing portion of the copier during use, the height of the stack reduces and as it does so, the tray is elevated automatically to keep the top sheet of the stack in contact with the feed mechanism. To replace or change the stack of copy sheets at any time the support tray is automatically lowered to a base position in response to an appropriate signal, for example when the cover door is opened or when the operator presses an appropriate control button.

In some circumstances it may be desirable to change the stack of copy sheets quite frequently. For example, particularly in a "copy centre" environment, there will be a need to run a whole variety of different throughput materials such as various weights and colors of paper, card stock, pre-punched paper, envelopes, labels, transparencies for overhead projectors, drawing film, and customized pre-printed materials like letter headed paper.

Each time a different throughput material is used the stack has to be physically handled by the operator first as it is inserted into the machine and subsequently as it is removed to make way for a stack of different material. During handling and also during storage the loose stacks of different sheets are vulnerable to contamination and damage which are detrimental to copy quality, high performance machines especially being sensitive to the surface characteristics of the copy sheets, their moisture content, and also to any debris present on the surface of the sheets.

U.S. Pat. No. 4,504,053 to Shiozawa discloses a sheet feed apparatus comprising a fixed base table on which is located a sheet containing bin. A lift is located at the center of the base table and is arranged to rise through an opening therein. The bin, which has a completely open top face, also has an opening in its bottom face through which the lift moves to engage a pallet supporting a stack of sheets within the bin thus raising the stack to a top-sheet feeding apparatus, the bin being locked automatically to the base table when the lift is operational. U.S. Pat. No. 4,248,525 to Sterret demonstrates an example of a top feeding sheet feeder having a support tray movable vertically upward to maintain sheets in operational position. U.S. Pat. No. 4,569,587 to Miyoshi et al. teaches an upwardly biased paper supply cassette which makes sheets available for top feeding. U.S. patent application Nos. 654,706 filed Sept. 27, 1984, and 654,705 filed Sept. 27, 1984 both teach containers for supporting a large number of sheets for feeding.

According to a first aspect of the present invention a sheet feed apparatus having the features specified in the opening paragraph is characterized in that at least one upwardly projecting member is present on the tray in fixed relation therewith, and in that the stack of sheets is provided on the tray in a cartridge having in its bottom face adjacent the support tray an opening permitting entry of said projecting member, the cartridge containing a vertically movable plate for supporting the stack of sheets and extending over the bottom face thereby in operation the projecting member on the elevating tray bears against the underside of the plate so that the plate and the stack are lifted to bring the top-sheet of the stack into operative contact with the feed means.

Preferably the opening in the bottom face is complementary to the projecting member, thereby providing a locating feature for the cartridge on the tray.

In one embodiment the cartridge comprises a generally enclosed rectangular container for holding the stack of sheets, the container having a first opening in the top face for exposing a portion of the top sheet to permit the sheet feed means to engage said top sheet, a second opening in a side face and extending to the top edge of said side face, through which second opening sheets can be fed from the top of the stack, and a third opening in the bottom face arranged to permit entry of the projecting member, whereby in operation the projecting member(s) of the elevating tray bears against the underside of the plate so that the plate and the stack of sheets supported thereon are lifted within the container to bring the top sheet of the stack into contact with the top face of the container thereby raising the container until the top sheet of the stack is brought into operative contact with the sheet feed means.

According to another aspect of the present invention there is provided a cartridge for use in the sheet feed apparatus in accordance with the first aspect, comprising a generally enclosed rectangular container for holding a stack of sheets to be fed, the container having a first opening in the top face for exposing a portion of the top sheet of the stack to permit the sheet feed means to engage the top sheet when the cartridge is in use in the sheet feed apparatus, a second opening in a side face, through which second opening sheets can be fed out from the top of the stack when the cartridge is in use in the sheet feed apparatus, and a third opening in the bottom face arranged to permit entry of the projecting member(s) when the cartridge is in use in the sheet feed apparatus, the cartridge further comprising a vertically movable plate for supporting the stack of sheets, said plate being disposed within the container adjacent the bottom face and extending over the third opening such that when the cartridge is in use in the sheet feed apparatus the underside of said plate is engaged by said projecting member(s).

The use of this cartridge to hold the stack of sheets not only simplifies change over of throughput material, but also means that the individual sheets are less likely to be damaged or contaminated because the operator does not actually touch the stack when it is being loaded into and out of the sheet feed apparatus. The cartridge also provides a convenient means of storing either full or part-used stacks of sheets, its generally enclosed construction helping to protect the contents from the environment without the need for a separate protective storage box.

According to yet a further aspect of the invention there is provided an adaptor for converting a sheet feed apparatus having an automatically elevating stack support tray to operate with a stack of sheets provided in a cartridge in accordance with the previous aspect, the adaptor comprising at least one projecting member, and means for attaching the projecting member(s) to the upper side of the support tray.

With this adaptor a conventional sheet feed apparatus having an automatically elevating stack support tray can be converted quickly and easily to operate with a cartridge instead of a loose stack of sheets.

An embodiment of the invention will now be described by way of example with reference to the accompanying drawings in which.

Figure 1:
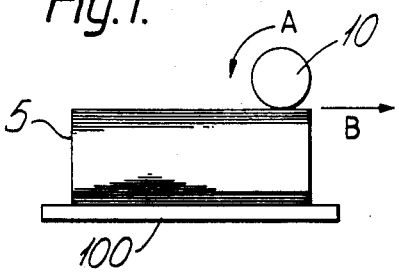
FIG. 1 is a schematic sectional view of a known sheet feed apparatus of the automatic elevator type.

For comparative purposes there is shown schematically in FIG. 1 a known sheet feed apparatus of the type used in the main paper supply tray of commercially available xerographic machines such as the Xerox 9700 and 1050. The apparatus comprises a horizontal support tray 100 on which is located a loose stack of sheets 5 to be fed. The sheets may be retained by lateral guide members not shown in the Figure. The support tray 100 is driven and controlled in such a manner that it rises automatically to keep the top sheet of the stack in operative contact with a top-sheet feed roll 10 so that when the roll 10 is driven in the direction of arrow A the top sheet is fed from the stack in the direction of arrow B into the copier.

Figure 2:
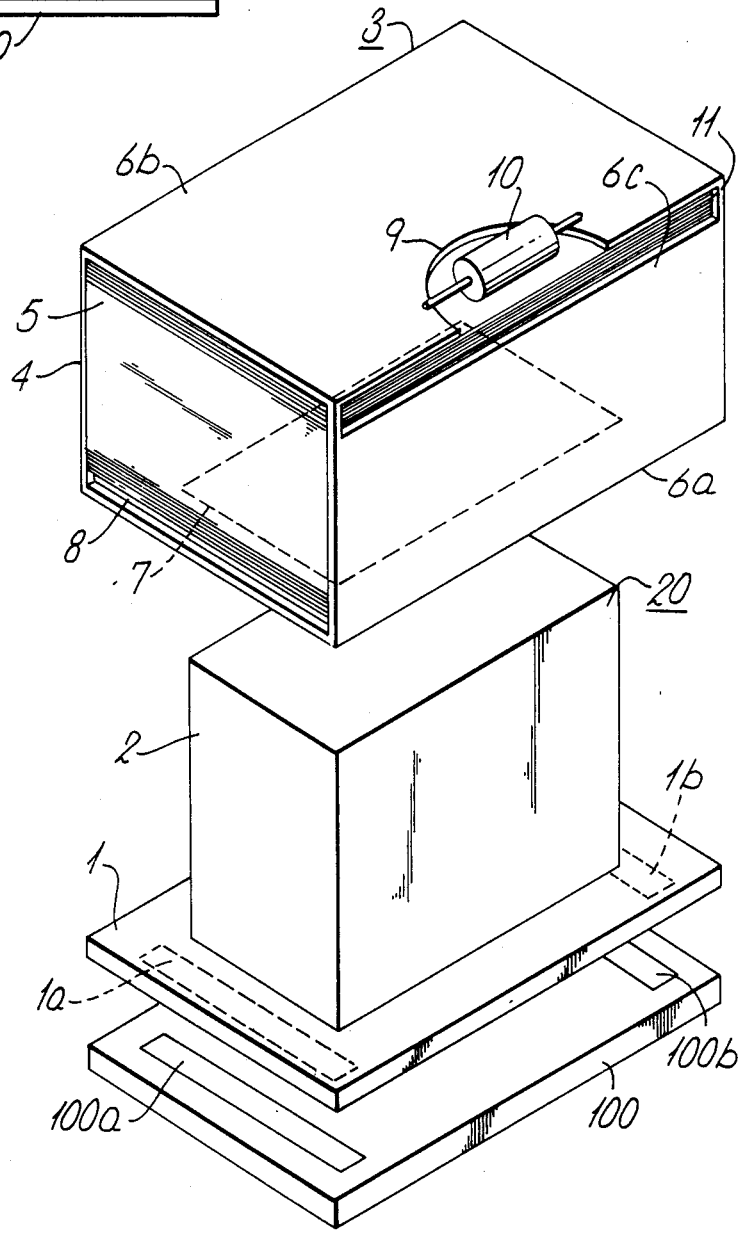
FIG. 2 is a schematic perspective view of a sheet feed apparatus employing a cartridge for holding the sheets to be fed in accordance with the invention.

FIG. 2 shows how the known apparatus is converted to operate with a cartridge in accordance with the invention. For this purpose an adaptor 20 is provided which comprises a flat rectangular platform 1 having an upwardly projecting rectangular block 2 at its center. The adaptor 20 is attached to the elevating paper tray 100, for example, by means of complementary magnetic strips 1*a;* 1*b;* 100*a;* 100*b* disposed on the underside of the platform 1 and the upper side of the tray 100 respectively. If, however, the tray 100 itself is made of a material which is itself magnetic, e.g. steel, the magnetic strips thereon can be dispensed with. Needless to say there are many different ways of fixing the adaptor 20 to the tray 100, for example by screwing, riveting or gluing. The advantage of the adaptor is that it enables an existing apparatus having a conventional flat elevating support tray 100 to be converted quickly and easily by the operator without the need for a retrofit by a skilled engineer. Also, the adaptor can easily be removed or replaced by the operator for different applications. Alternatively, however, the projecting member may be designed into the original apparatus in which case the projecting member may be provided as an integral part of the elevating paper tray.

Above the block 2 is present a cartridge 3 holding the stack of sheets 5 to be fed. The cartridge 3 comprises a generally enclosed rectangular container 4 made, for example, of paper board or plastics materials. In FIG. 2 the walls of the container 4 are shown to be transparent so the contents can readily been seen. In the bottom face 6*a* of the container 4 at the center is a rectangular aperture 7 slightly larger than the block 2.

Inside the container 4, adjacent the bottom face 6*a* is a rigid, rectangular plate 8 covering the aperture 7. The plate which may be made of, for example, paper board, is loose and, being slightly smaller than the container 4, is slidable vertically therein. The stack of sheets 5 to be fed is disposed on the plate 8. The lateral dimensions of the container are such that the stack of sheets fits loosely therein and the depth of the container 4 is chosen to accommodate the desired number of sheets, typically 500 or 1000. The top face 6*b* of the container 4 has a concave cutaway portion 9 at the front edge, exposing the top sheet of the stack. The top-sheet feed roll 10 can thus bear against the top sheet and as the feed roll 10 is rotatably driven the top sheet is fed out through an elongate aperture 11 at the top edge of the front face 6*c* of the container 4, the aperture 11 extending substantially the full width of the front face 6*c*.

Figure 3C:
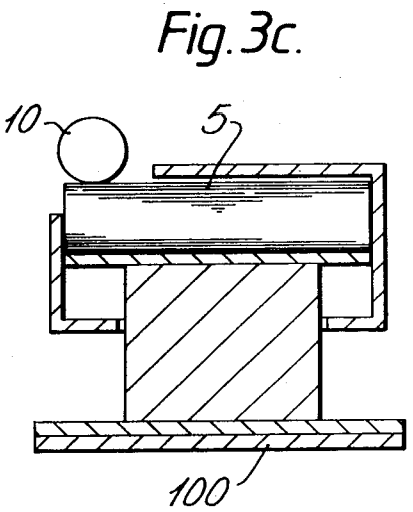
FIGS. 3*a* to 3*c* are schematic sectional views of the sheet feed apparatus in FIG. 1 at various stages during operation.
Figure 3B:
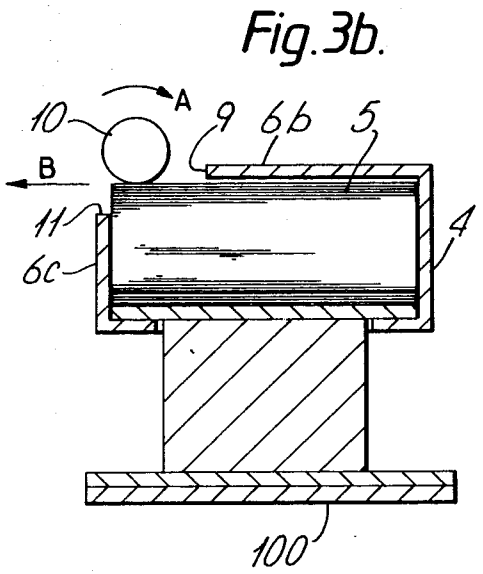

The manner in which the apparatus operates with a cartridge as described above will now be described with references to FIGS. 3*a* to 3*c*.

Figure 3A:
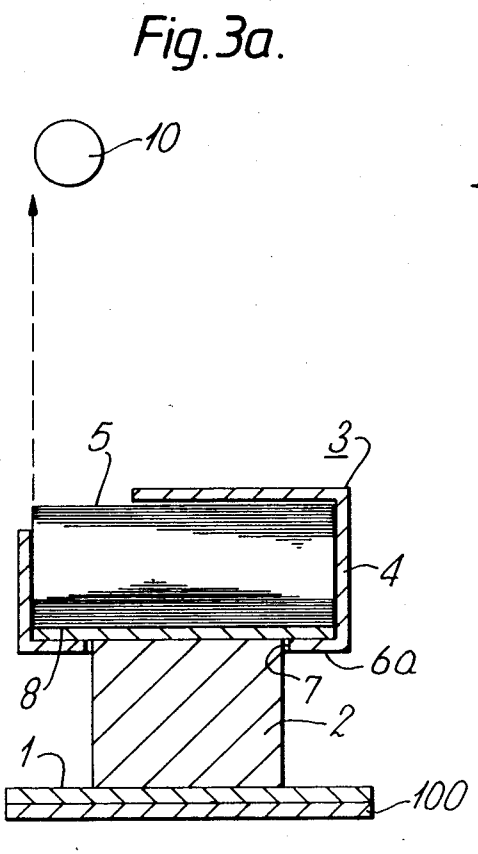

In order to insert or change a cartridge 3 the support tray 100 is lowered automatically (as in the known apparatus) to a base position well below the level of the feed roll 10 as shown in FIG. 3*a*. The operator then takes the cartridge 3 filled, or partially filled, with the stack of sheets 5 to be fed, and locates the aperture 7 in the bottom face 6*a* of the container 4 over the projecting block 2 so that the block 2 bears against the uunderside of the plate 8 inside the container 4. The tray 100 is then raised automatically (again as in the known apparatus) until the top-sheet feed roll 10 engages the top sheet of the stack 5 through the aperture 9 in the top face 6*b* of the cartridge container 4, see FIG. 3*b*. As the feed roll 10 is driven in the direction of arrow A the top sheet is fed from the stack out through the elongate aperture 11 in the front face 6*c* of the container 4 in the direction of arrow B into the copier. FIG. 3*c* shows the situation when about half of the sheets have already been fed from the stack and the tray 100 has been raised automatically to compensate so as to keep the top sheet in contact with the feed roll 10. The tray will continue rising automatically until the last sheet in the stack has been fed, whereupon it may be lowered automatically back to the base position for the operator to reload a fresh cartridge. It will be evident from the foregoing that the height of the block 2 must be approximately the same as (or greater than) the depth of the container 4 in order to ensure that the bottom sheets of the stack will be pushed up as far as the feed roll 10.

Before the entire stack of sheets has been used up the tray 100 may be lowered at the operator's instigation, e.g. by pushing a control button or opening a cover door in known manner. Thus a cartridge can be removed before it is empty and changed for a different cartridge containing different sheet material, e.g. different colored paper. Of course the newly inserted cartridge may contain a part-used stack of sheets in which case FIG. 3*c* represents the situation immediately after the cartridge has been inserted and the tray 100 has been raised automatically until the top sheet of the part-used stack engages the feed roll 10. As before the tray 100 will continue to rise automatically thereafter to keep the top sheet in operative contact with the feed roll 10 until all the sheets have been fed or until the operator wishes to change the cartridge again.

It will be evident to a person skilled in the art that various modifications may be made within the scope of the present invention. For example, the aperture in the top face of the container may be rectangular rather than concave, and may extend the full width of the cartridge. Also, the projecting member may comprise, instead of a relatively large central block, an array of, for example five pillars, four being located at the corners of a rectangle and one at the center thereof. In this case, the opening in the bottom face of the container may remain as a single rectangular aperture, but large enough to accommodate all the pillars, or alternatively there may be five individual apertures complementing the five pillars.

I claim:

1. In a sheet feed apparatus having a support tray for a stack of sheets to be fed, sheet feeding means for feeding a top sheet of the stack, and elevator means for elevating the support tray automatically to maintain the top sheet of the stack in operative contact with the sheet feed means, the improvement comprising:

at least one upwardly projecting member on the support tray in fixed relationship therewith, and removably mounted on said support tray;

a cartridge for holding the sheet stack having an opening in a bottom face adjacent the support tray permitting entry of said projecting member; and a vertically movable plate contained in said cartridge for supporting the stack of sheets in said cartridge, and extending over the opening in the bottom face whereby the projecting member on the elevating tray bears against an underside of the plate so that the plate and the stack of sheets supported thereon are raised to bring the top sheet of the stack into operative contact with the feed means.

2. A sheet feed apparatus as claimed in claim 1, wherein the opening in the bottom face of the cartridge is complementary to the projecting member, thereby providing locating means for the cartridge.

3. A sheet feed apparatus as claimed in claim 1, wherein said cartridge comprises a generally enclosed rectangular container for holding the stack of sheets, said container having a first opening in a top face thereof for exposing a portion of the top sheet therein to permit the sheet feed means to engage said top sheet, a second opening in a side face and extending to a top edge of said side face, adjacent said top face, through which sheets can be fed from the top of the stack, whereby upward movement of the sheet stack within the cartridge carries the cartridge upwardly until the top sheet of the sheet stack is brought into operative contact with the sheet feed means.

4. A sheet feed apparatus as claimed in claim 1, including attachment means for attaching said at least one projecting member to an upper side of the support tray, to removably mount the projecting member in fixed relationship with said support tray.

5. In a sheet feed apparatus, having a support tray for holding a loose stack of sheets to be fed, sheet feeding means for feeding a top sheet from the loose stack of sheets, elevator means for elevating said tray automatically to maintain top sheet of the loose stack of sheets in operative contact with the sheet feed means, and at least one upwardly projecting member on the sheet tray in fixed relationship therewith, and removably mounted on said sheet tray, and a cartridge for holding an enclosed stack of sheets for feeding from said loose sheet stack support tray, said cartridge comprising;

a generally enclosed rectangular container having a first opening in a top face for exposing a portion of the top sheet of the enclosed stack of sheets to permit the sheet feeding means to engage said top sheet in said cartridge when the container is in use in the sheet feed apparatus, a second opening in a side face extending to the top edge of said side face adjacent said top face, through which sheets can be fed from the top of the the enclosed stack of sheets by said sheet feeding means, and a third opening in a bottom face permitting entry of said projecting member; and a vertically movable plate in said container supporting the enclosed stack of sheets in said container, extending over the opening in the bottom face, whereby the projecting member on the elevating tray extends through the third opening to bear against an underside of the plate so that the plate and the enclosed stack of sheets supported thereon are raised to bring the top sheet of the enclosed stack of sheets into operative contact with the sheet feed means.

6. A dual mode sheet feed apparatus, for feeding loose stacks of sheets in a first mode and sheets from a stack of sheets contained within a cartridge in a second mode, including:

a support tray for supporting loose stacks of sheets to be fed in said first mode;

sheet feeding means for feeding a top sheet of the stack;

elevator means for elevating said tray automatically to maintain the top sheet of the stack in operative contact with the sheet feed means;

at least one upwardly projecting member removably mounted on the support tray in fixed relationship therewith for advancing sheets to a feeding position from a cartridge in said second mode;

a cartridge for holding an enclosed sheet stack, having an opening in a bottom face adjacent the support tray permitting entry of said projecting member; and a vertically movable plate contained in said cartridge for supporting the stack of sheets in said cartridge, and extending over the opening in the bottom face whereby the projecting member on the elevating tray bears against an underside of the plate so that the plate and the stack of sheets supported thereon are raised to bring the top sheet of the stack into operative contact with the feed means.

* * * * *